US008251212B2

(12) United States Patent
Dunlap

(10) Patent No.: US 8,251,212 B2
(45) Date of Patent: Aug. 28, 2012

(54) SMALL HAND CARRIED BARREL-SHAPED CASE FOR THE STORAGE AND DISPENSING OF SPOOLS OF ELECTRICAL WIRE

(76) Inventor: Rodney Dunlap, McHenry, IL (US)

( * ) Notice: Subject to any disclaimer, the term of this patent is extended or adjusted under 35 U.S.C. 154(b) by 0 days.

(21) Appl. No.: 12/800,167

(22) Filed: May 10, 2010

(65) Prior Publication Data

US 2012/0085668 A1 Apr. 12, 2012

Related U.S. Application Data

(60) Provisional application No. 61/178,463, filed on May 14, 2009.

(51) Int. Cl.
*B65D 85/672* (2006.01)
*B65H 75/18* (2006.01)

(52) U.S. Cl. ..... 206/403; 206/409; 220/230; 242/170; 242/588.2; 242/588.3

(58) Field of Classification Search ..... 206/53–55, 206/403–405, 408, 409; 242/170, 171, 348.1–348.4, 242/587, 588.2–588.6; 220/4.06, 4–7, 4.22–4.25, 220/230

See application file for complete search history.

(56) References Cited

U.S. PATENT DOCUMENTS

| | | | | |
|---|---|---|---|---|
| 3,150,769 | A * | 9/1964 | Cohn | 242/588.2 |
| 3,152,716 | A * | 10/1964 | Feldhahn | 220/230 |
| 5,482,223 | A * | 1/1996 | Bresina et al. | 242/348.4 |
| 6,491,163 | B1 * | 12/2002 | Grcic et al. | 206/403 |
| 8,052,078 | B2 * | 11/2011 | DeLuca et al. | 242/170 |
| 2006/0070905 | A1 * | 4/2006 | Hampel | 206/403 |
| 2010/0163667 | A1 * | 7/2010 | Dorais et al. | 242/587 |

* cited by examiner

*Primary Examiner* — Bryon Gehman
(74) *Attorney, Agent, or Firm* — Justin Lampel

(57) ABSTRACT

The Invention is a hand carried barrel shaped plastic molded case with two mating sides connected with a hinge, which when the case is closed around a spool of wire, protect the wire from damage during storage, transport and use. The case has an integral handle to make transport of the wire easier and helps protect the spool from damage if the case is dropped. The case incorporates locking tabs on the two sides of the case. The case also comes with a locking hole in the handle through which a padlock can be placed to prevent theft of the wire. The case has a dispensing hole or slot for the wire. The case can be translucent or molded of different colors to correspond to specific types or gauges of wire.

3 Claims, 6 Drawing Sheets

SMALL HAND CARRIED BARREL-SHAPED CASE FOR THE STORAGE AND DISPENSING OF SPOOLS OF ELECTRICAL WIRE

RELATED APPLICATION

This application is based on, and claims the benefit of, U.S. provisional application No. 61/178,463 filed on May 14, 2009. The entire contents which are incorporated by reference.

BACKGROUND OF THE INVENTION

Copper wire for the commercial and residential market is typically supplied on a plastic spool. The wire comes in different gauges, and a typical spool may contain 500 feet as an example. In a typical job setting, electricians may use individual spools of wire that they carry to the job site or they may put multiple spools on a wire cart or rack. The wire is heavy and difficult to carry. The wire is unprotected and subject to damage during storage, transport and use. Damage may occur to the protective insulation covering the wire by many different causes. If this occurs it creates a major safety hazard, which could ultimately create an electrical short and start a fire. Some of the ways an unprotected wire spool could become damaged are listed as follows: 1. The wire spool is heavy. There is no convenient way to carry the wire. If dropped the wires pool may break resulting in a sharp edge on the wire reel. While the wire is being unwound for use, the wire insulation can be cut on the sharp edge of the spool. 2. It is not unusual to have electrical contractors working on a job site along with other tradesmen such as welders, plumbers and carpenters. The work site can be crowded with equipment. The electrical wire is typically in close proximity to welding equipment, saws, and other tools. Tradesman often work in the ceiling above the electrical contractor and over the unprotected spools of wire. The electrician typically stores the open reel of electrical wire in the back of the truck or tool box along with other equipment. The wire insulation can be snagged on sharp tools during transport. After the job is completed for the day, it is not unusual for the electrician to throw the unused wire in the back of the truck and in this can be another source of damage.

Accordingly, it is the general object of the present invention to provide a protective case to be placed over the spool of electrical wire to protect it during storage and transport. The case protects the plastic wire spool from potential breakage if dropped or being accidentally hit by a hard object that may be close in proximity to the wire spool in the back of a truck or storage box. Should an edge of the wire spool become broken, then the electrical wire is exposed to this sharp edge and the insulation may become damaged during use, creating a safety hazard.

It is a further object of the invention to provide a convenient way to carry the heavy wire spool. The protective case incorporates a handle for this purpose. The handle facilitates safe transport of the wire.

It is a further object of the invention to protect wire if the wire spool is used on a wire rack and moved throughout the job site. The case prevents to debris, and sharp objects during use on the job site.

It I another object of the invention to be able to place the case directly over the wire spool without first having to remove the wire spool from the spindle of the wire rack.

It is a further object of the invention to provide a dispensing hole or slot for the wire.

It is another object of the invention to prevent the wire spool from free spinning on the spindle of a wire rack and thus preventing the wire from becoming tangled.

These and other aspects of the present invention are set forth in the following description of the attached drawings which depict the preferred embodiments of the invention.

SUMMARY OF THE INVENTION

Figure 1:
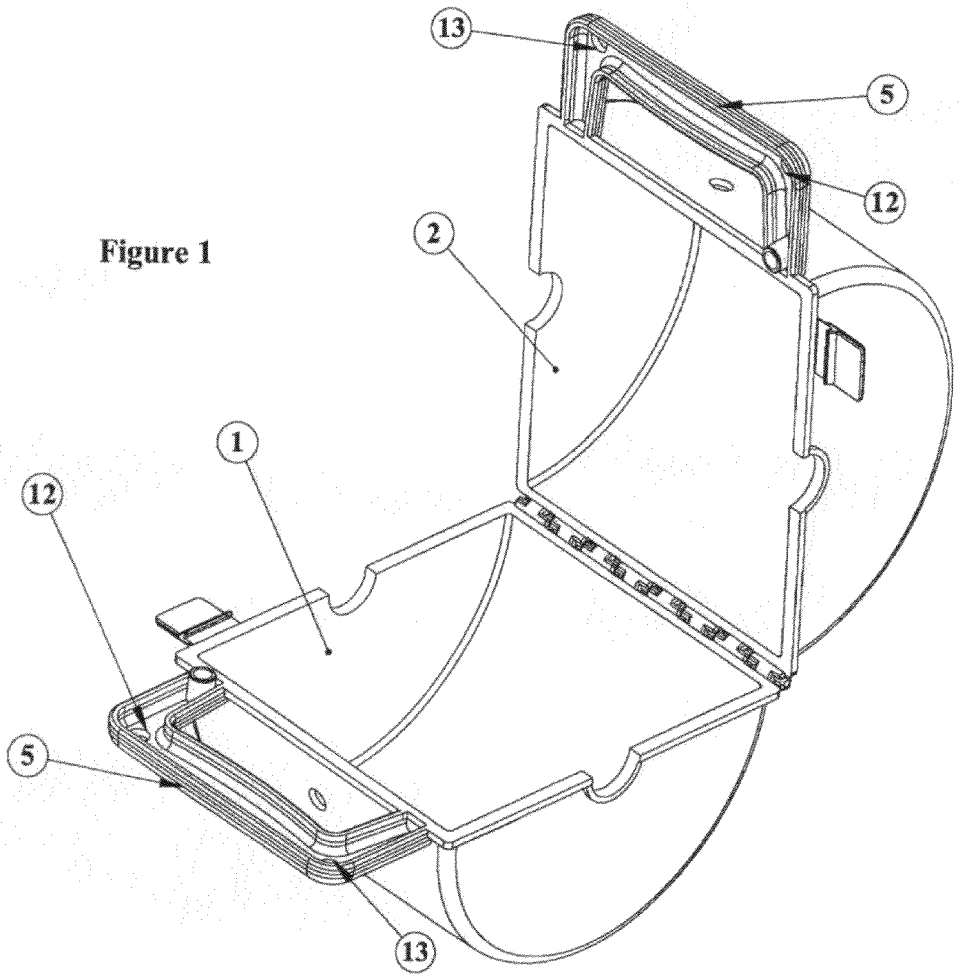
FIG. 1 is an isometric view of the empty wire case. In the preferred design, the protective case is made from plastic. The invention is comprised of two identical halves (1) and (2). Each half is comprised of the following identifiers: interlocking hinge (3), hinge pin (4), half handle (5), locator nipple (6), locking tab (7), locking ridge (8), wire dispensing hole (9), two semicircle holes one per side (10). In the preferred design the handle may have two molded in holes (12,13). One hole can be used to lock and secure the case with a padlock and the other hole can be used to wrap wire around the handle after wire has been dispensed and cut off

Referring to FIG. 1, the invention is comprised of two identical halves (1) and (2). Each half is comprised of the following identifiers: interlocking hinge (3), hinge pin (4), half handle (5), locator nipple (6), locking tab (7), locking ridge (8), wire dispensing hole (9), two semicircle holes one per side (10) when closed the case can be placed over a cylindrical spindle (14) on a wire cart. In the preferred design the handle may have two molded in holes (12,13). One hole can be used to lock and secure the case with a padlock and the other hole can be used as a convenient place to wrap wire around the handle after wire has been dispensed and cut off to prevent it from becoming tangled inside the case.

Figure 2:
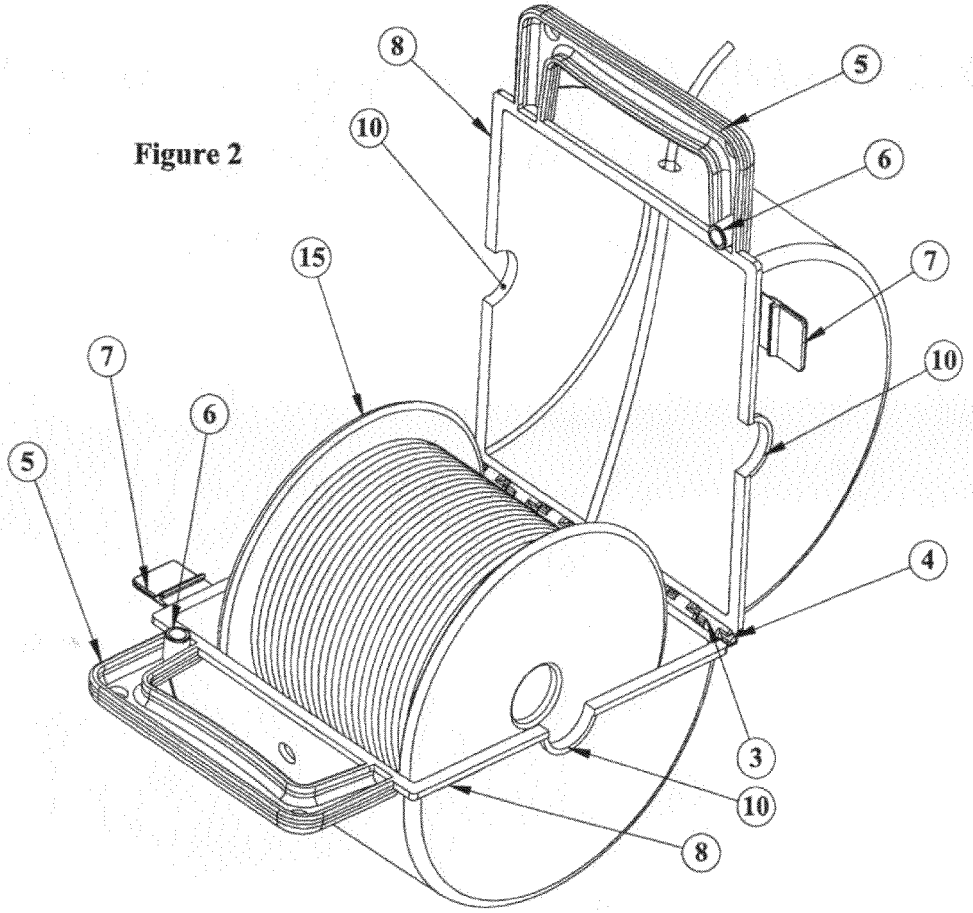
FIG. 2 is an isometric view of the open wire case containing the reel of the wire (15).

Referring to FIG. 2 the wire reel is loaded into one half of the case. It should be noted that this view depicts the individual wire reel that would taken to the job site, without being placed on a wire rack. Each half is connected at one end by the Hinge (3). In an alternative design, the case could be molded in one piece. When the halves are folded together, a handle is formed. The molded dispensing hole (9) could be a rectangular slot. The locking tabs could be alternatively be located on the handle instead of the other side. When the case is closed, a hole could be molded into the handle to accept a padlock. A second hole could be provided to secure the end of the wire when it cut. The case could have an optional spindle to aid in the easy dispensing of the wire however we have not found this to be advantageous.

Figure 3:
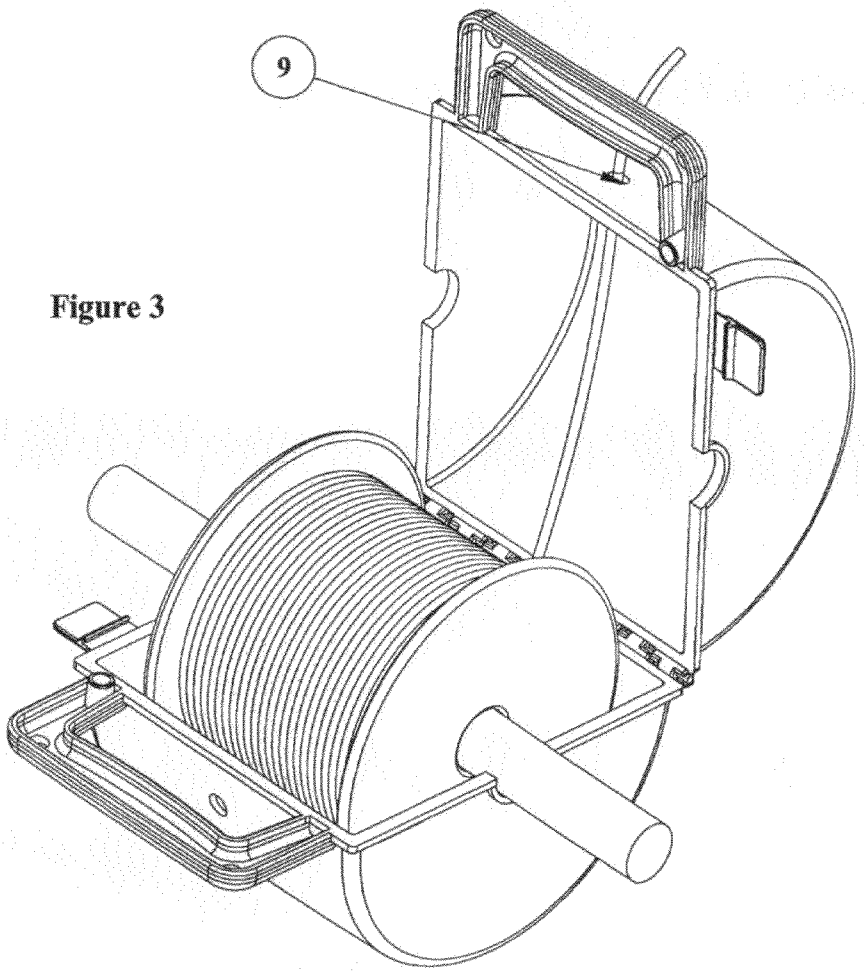
FIG. 3 is an isometric view of the open case containing the reel of the wire with the end of the wire coming out of the dispensing hole. The wire reel is also depicted as if it were a spindle of a wire rack.
Figure 4:
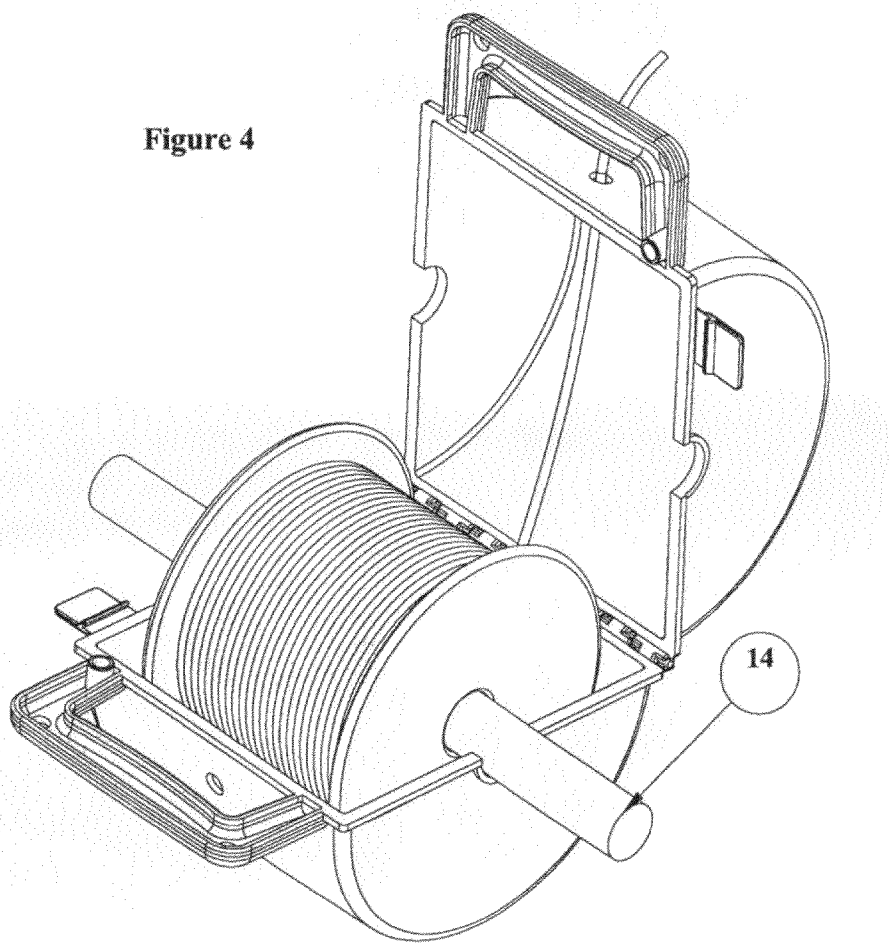
FIG. 4 is an isometric view of the open wire case identifying the cylindrical spindle (14) on a wire cart.

Referring to FIG. 3 and FIG. 4, these are views are showing the wire spool in the open case with the wire extending through the dispensing hole. In this embodiment, the wire case is shown being placed over the wire spool that is on the spindle of the wire rack. The advantage of the design is that the wire spool does not need to be removed from the spindle. The protective case can simply be placed directly over the wire spool.

Figure 6:
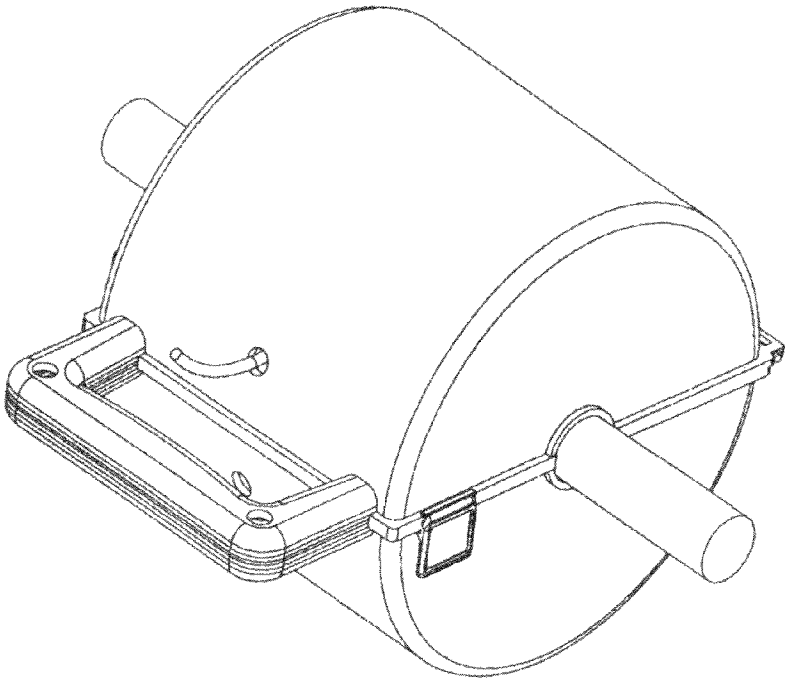
FIG. 6 is an isometric view of the closed case with the locking tabs in the locked position.

Referring to FIG. 6, as you are closing the case over the spool of the wire (15) and before shutting the case completely you first thread the loose end of the wire through the dispensing hole (9). Once the case is closed over the wire spool the locking tabs (7) are then pressed and they snap over the locking ridges (8). This closing of the case causes the two identical halves to become aligned and the two halves of the handle (5) mate together to form a single, easy to grip handle. Once closed, the semi circles on each side of the case mate together to form a hole around which the case is placed over the cylindrical spindle (14) of the wire rack or cart. The locking tabs could alternatively be located on the handle instead of the side. When the case is molded, a hole (12) could be molded into a handle to accept a padlock. A second hole (13) could be provided to secure the end of the wire when it is cut. The case could have an optional spindle to aid in the easy dispensing of the wire when the spool is not being used on a wire dispensing rack. Refer to FIG. 3.

Figure 5:
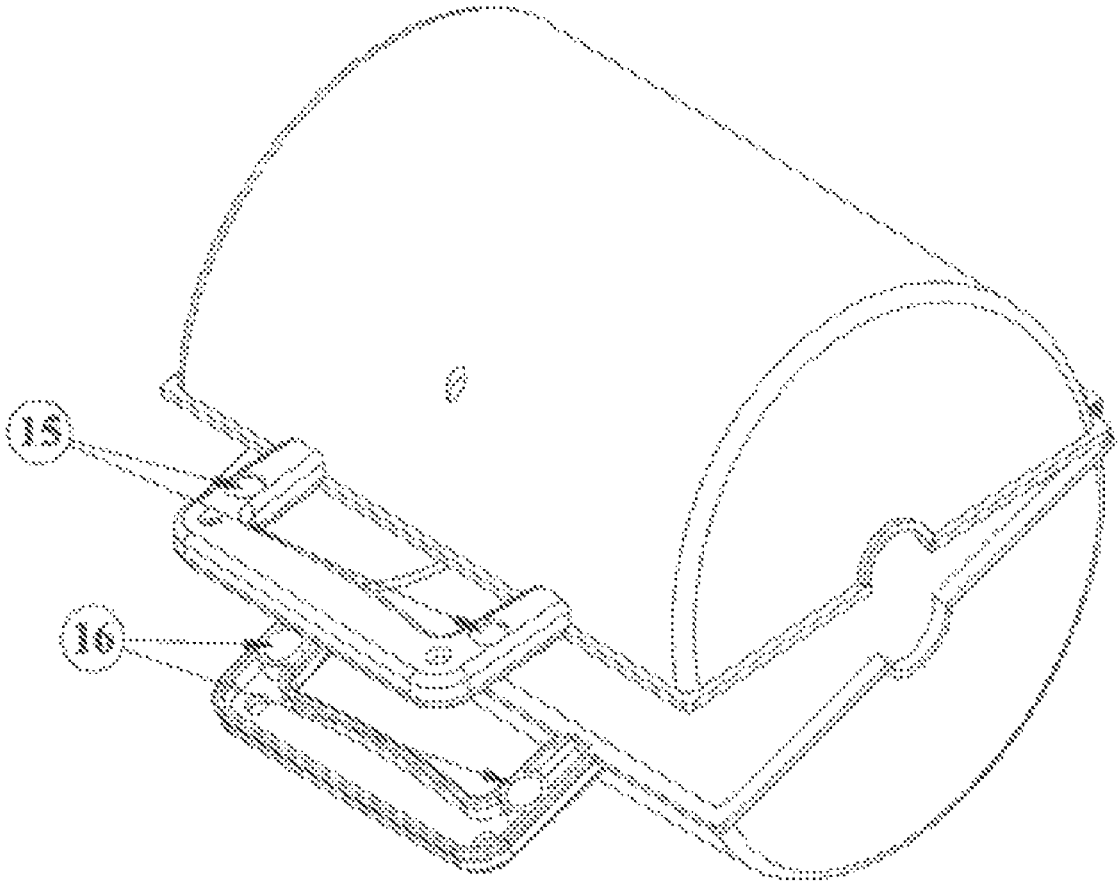
FIG. 5 is an isometric view of a case showing magnets placed in the handle as an alternative means of closing and securing the case without the need of locking tabs on the side.

Referring to FIG. 5, an alternative method of closing and securing the case instead of locking tabs (7) would be the use of magnets (15) placed in one side of the handle and a mating piece of steel (16) placed opposite the magnets on the other side of the handle. To increase magnetism, (16) could also be magnets instead of steel.

Once the case is placed over a spool of electrical wire and the loose end of the wire is placed through the dispensing hole the user simply pulls what they need by tugging on the wire and the spool spins inside the case. The case stops the wire from over dispensing or tangling on itself In the preferred design, the case would be injection molded and connected together with a hinge and pin. An alternative could be a one-piece design with a flexible molded in hinge however the size then makes the injection molding tool expensive. An alternative method would be thermoforming a one piece part. In the preferred design each half is identical. This allows for a more reasonable tool size for molding and less cost.

The case can be molded from different color plastic which relates to the type and color wire being utilized. This could be a quick visual aid to the electrician. An alternative could be to make one half of the case clear, and the other half colored. In the preferred design, the material is translucent in order to be able to see the spool through the plastic case. This enables the electrician to easily estimate the amount of wire remaining on the spool before starting a new job.

There are two basic ways to use the case. First, the person opens the case and places the wire spool inside. Next the wire is fed through the dispensing hole and the case is closed and locked. This then allows the person to carry the case to the job site and dispense the wire. Second, if a wire dispensing rack or cart is being utilized on the job site, the person would open the case and place it around the wire spool and spindle (14) of the rack. Refer to FIG. 4. The wire would be fed through the dispensing hole and the case would be closed and locked (FIG. 6). This allows for safe and tangle free dispensing of the wire. One of the issues encountered with current, unprotected wire spools is that during use, the spools continue to spin after the electrician pulls the wire. This results in tangled wire, requiring the electrician to stop his work to untangle and rewind the wire. The case prevents this from happening because the wire spool rests on the inside of the case, creating enough friction to prevent the spool from over spinning during use.

With appropriate modification, the invention could be used for storage and dispensing of many types of hose, cord, yarn, electrical cords, flat strapping or banding material.

The invention claimed is:

1. A protective case for a spool of electrical wire comprising:

the case formed from a first unit and a second unit wherein the first unit has a first side, a second side, an exterior surface, an interior and a largely square-shaped edge and wherein the second unit has a first side, a second side, an exterior surface, an interior and a largely square-shaped edge;

a hinge located between and connecting the first unit and the second unit wherein the hinge allows for the first unit to rotate approximately one hundred and eighty degrees from a first position to a second position with respect to the second unit and wherein the largely square-shaped edges of the first unit and the second unit align in the second position and wherein a completely hollow interior of the protective is created when the first unit and second unit are in the second position;

a largely circular opening located on the second unit wherein the largely circular opening allows for the passage of an electrical wire from the interior of the case to the exterior of the case, and wherein the first unit and the second unit are secured together by a first magnet and a second magnet wherein the first magnet is located on the first unit and the second magnet is located on the second unit and wherein the first and second magnet are located on the opposite sides of the first and second units from the hinge and wherein a spool of electrical wire may be received within the interior of the case when in the second position;

a second opening created by the closing of the case in the second position wherein the second opening is formed from a partial opening on the first unit and a partial opening on the second unit and wherein the received spool of electrical wire rotates around an axis extending through the second opening;

a first tab located on the first unit and a second tab located on the second unit wherein the first tab and the second tab correspondingly connect together and lock the protective case in the second position and prevent the spool of electrical wire from accidentally exiting the interior of the protective case; and a handle located on the case wherein the handle is formed from a portion of the first unit and a portion of the second unit wherein the handle is formed when the first unit and the second unit are secured together in the second position.

2. The protective case of claim 1 wherein the protective case is transparent.

3. The protective case of claim 1 wherein the protective case is colored to correspond to a type of electrical wire contained within the interior of the case.

* * * * *